US010759067B2

(12) United States Patent
Huang

(10) Patent No.: US 10,759,067 B2
(45) **Date of Patent: *Sep. 1, 2020**

(54) FOLDING KNIFE CONFIGURED FOR RAPID ASSEMBLY AND DISASSEMBLY

(71) Applicant: GB II Corporation, Tualatin, OR (US)

(72) Inventor: Frank Huang, New Taipei (TW)

(73) Assignee: GB II Corporation, Tualatin, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/297,062

(22) Filed: Mar. 8, 2019

(65) Prior Publication Data

US 2019/0202073 A1 Jul. 4, 2019

Related U.S. Application Data

(63) Continuation of application No. 15/593,362, filed on May 12, 2017, now Pat. No. 10,226,871.

(30) Foreign Application Priority Data

Apr. 10, 2017 (TW) ..... 106111935 A

(51) Int. Cl.

| | |
|---|---|
| ***B26B 5/00*** | (2006.01) |
| ***B26B 1/10*** | (2006.01) |
| ***B26B 1/04*** | (2006.01) |

(52) U.S. Cl.

CPC ..... *B26B 5/00* (2013.01); *B26B 1/04* (2013.01); *B26B 1/044* (2013.01); *B26B 1/10* (2013.01)

(58) Field of Classification Search

CPC .. B26B 1/044; B26B 5/00; B26B 1/04; B26B 1/10

See application file for complete search history.

(56) References Cited

U.S. PATENT DOCUMENTS

| | | | |
|---|---|---|---|
| 298,115 | A | 5/1884 | Peace |
| 1,049,931 | A | 1/1913 | Smith |
| 1,182,043 | A | 5/1916 | Schless |
| 1,299,173 | A | 4/1919 | Grey |

(Continued)

FOREIGN PATENT DOCUMENTS

| | | | |
|---|---|---|---|
| CN | 2194827 | Y | 4/1995 |
| CN | 2275020 | Y | 2/1998 |

(Continued)

*Primary Examiner* — Omar Flores Sanchez

(74) *Attorney, Agent, or Firm* — Klarquist Sparkman, LLP

(57) ABSTRACT

A folding knife includes a blade, first and second handle portions, a post, and an engaging plate. The post extends from the first handle portion. The blade is pivotable relative to the handle portions about a pivot axis between open and closed positions. The engaging plate is coupled to the second handle portion and is movable relative to the second handle portion between first and second positions. In the first position, the engaging plate engages the post, thereby restricting relative movement between the first and second handle portions in a direction parallel to the pivot axis and retaining the blade between the first and second handle portions. In the second position, the engaging plate disengages the post, thereby allowing relative movement between the first and second handle portions in the direction parallel to the pivot axis and allowing the blade to be separated from the first and second handle portions.

20 Claims, 9 Drawing Sheets

(56) References Cited

U.S. PATENT DOCUMENTS

| | | | |
|---|---|---|---|
| 1,350,251 | A | 8/1920 | Armour |
| 1,428,296 | A | 9/1922 | Neft |
| 1,487,655 | A | 3/1924 | Hlavecek |
| 1,667,462 | A | 4/1928 | Logan |
| 3,061,927 | A | 11/1962 | Von Frankenburg und Ludwigsdorf |
| 3,829,967 | A | 8/1974 | Gilbert |
| 4,161,818 | A | 7/1979 | Phelps |
| 4,218,819 | A | 8/1980 | Phelps |
| 4,408,394 | A | 10/1983 | Phelps |
| 4,730,393 | A | 3/1988 | Coburn |
| 5,022,156 | A | 6/1991 | Kallens et al. |
| 5,572,793 | A | 11/1996 | Collins et al. |
| 5,594,966 | A | 1/1997 | Goldman |
| 5,605,495 | A | 2/1997 | Jenkins, Jr. |
| 5,661,908 | A | 9/1997 | Chen |
| 5,916,277 | A | 6/1999 | Dallas |
| 6,101,723 | A | 8/2000 | Ford |
| 6,134,788 | A | 10/2000 | Chen et al. |
| 6,591,504 | B2 | 7/2003 | Onion |
| 6,751,820 | B1 | 6/2004 | Wu |
| 6,802,126 | B2 | 10/2004 | Huang |
| 6,942,255 | B2 | 9/2005 | Pickering |
| 7,022,915 | B1 | 4/2006 | Galguera |
| 7,100,285 | B1 | 9/2006 | Huang |
| 7,162,803 | B2 | 1/2007 | Lu |
| 7,246,441 | B1 | 7/2007 | Collins |
| 7,370,421 | B2 | 5/2008 | Onion et al. |
| 7,716,839 | B2 | 5/2010 | Onion et al. |
| 8,051,518 | B2 | 11/2011 | Massaro |
| 8,087,173 | B2 | 1/2012 | Tang et al. |
| 8,893,389 | B2 | 11/2014 | Freeman |
| 9,586,328 | B2 | 3/2017 | Onion |
| 9,597,809 | B2 | 3/2017 | Onion |
| 10,226,871 | B2 * | 3/2019 | Huang ..... B26B 5/00 |
| 2005/0257377 | A1 | 11/2005 | Lu et al. |
| 2006/0272157 | A1 | 12/2006 | Zeng |
| 2007/0011884 | A1 | 1/2007 | Hua et al. |
| 2008/0222896 | A1 | 9/2008 | Marfione et al. |
| 2010/0177508 | A1 | 7/2010 | Maglica |
| 2010/0281696 | A1 | 11/2010 | Hao et al. |
| 2011/0041344 | A1 | 2/2011 | De et al. |
| 2011/0272265 | A1 | 11/2011 | Mortun |
| 2012/0011728 | A1 | 1/2012 | Keers |
| 2012/0017443 | A1 | 1/2012 | Hao |
| 2012/0124754 | A1 | 5/2012 | Frazer |
| 2012/0272534 | A1 | 11/2012 | Lee |
| 2014/0027234 | A1 | 1/2014 | Zhou et al. |
| 2014/0245615 | A1 | 9/2014 | Onion |
| 2016/0029733 | A1 | 2/2016 | Kovarik et al. |
| 2016/0031096 | A1 | 2/2016 | Koenig |
| 2016/0059429 | A1 | 3/2016 | Mayes |
| 2016/0311123 | A1 | 10/2016 | Schoon |
| 2017/0334077 | A1 | 11/2017 | Onion et al. |
| 2018/0290282 | A1 * | 10/2018 | Wang ..... B26B 1/044 |
| 2019/0202073 | A1 * | 7/2019 | Huang ..... B26B 1/04 |

FOREIGN PATENT DOCUMENTS

| | | | |
|---|---|---|---|
| CN | 2326401 | Y | 6/1999 |
| CN | 2385854 | Y | 7/2000 |
| CN | 2456890 | Y | 10/2001 |
| CN | 1303762 | A | 4/2004 |
| CN | 2774721 | Y | 4/2006 |
| CN | 2902614 | Y | 5/2007 |
| CN | 201401419 | Y | 2/2010 |
| CN | 201471444 | U | 5/2010 |
| CN | 201500984 | U | 6/2010 |
| CN | 201544254 | U | 8/2010 |
| CN | 104260025 | A | 1/2015 |
| GB | 108823 | A | 8/1917 |
| WO | WO1999-000224 | A2 | 1/1999 |

* cited by examiner

FOLDING KNIFE CONFIGURED FOR RAPID ASSEMBLY AND DISASSEMBLY

CROSS REFERENCE TO RELATED APPLICATIONS

This application is a continuation of U.S. patent application Ser. No. 15/593,362, filed on May 12, 2017, which claims the benefit of Taiwan Patent Application No. 106111935, filed Apr. 10, 2017, now Taiwan Patent No. I642524. The prior applications are incorporated by reference herein.

FIELD OF THE INVENTION

The present invention relates to folding knives and more particularly to one provided with an engaging plate so that a user can rapidly disassemble and reassemble the folding knife by operating the engaging plate.

BACKGROUND OF THE INVENTION

Commercially available folding knives are typically composed of a handle and a blade, wherein the blade is pivotally connected to the handle and can be rotated about the pivot joint in order to spin out of or be stored in the handle. Compact when folded up, this type of knives can be carried around with ease, and with the blade stored in the handle for enhanced safety. For those engaged in outdoor activities (e.g., divers), soldiers, the police, and so forth, folding knives are far more convenient than knives that are not foldable.

Generally speaking, a folding knife that has been used for quite a while tends to have dirt stuck in the handle as well as a blunt blade. To get rid of the dirt or detach the blade for sharpening. the folding knife must be disassembled. However, folding knives are rarely designed to be taken apart by their users. A folding knife is usually designed in such a way that the blade is pivotally connected between two plates, and that the plates are fastened together with screws or other elements to form the handle and to ensure stability of the folding knife during use. Indeed, such a design can prevent separation of the handle and the blade while the folding knife is being operated, but the same design also adds to the difficulty of disassembly and thus hinders maintenance of the folding knife.

To solve the aforesaid problem, many a structural improvement has been made to the conventional folding knives, as briefly described below. Referring to FIGS. 1A-1D, the folding knife 1 is composed of two plates 11A, 11B; a blade 13; and an actuating portion 15. One side of the plate 11A is protrudingly provided with a pivotal connection post 111 at a position adjacent to one end of the plate 11A. The pivotal connection post 111 is provided with a first block 113 on the top side. The portion between the first block 113 and the pivotal connection post 111 is reduced in diameter to form an engaging groove 1111. The first block 113 is rectangular and is arranged in a tilted manner (see FIG. 1C). The blade 13 is formed with a pivotal connection hole 131 at a position adjacent to one end of the blade 13. The pivotal connection post 111 extends into the pivotal connection hole 131 so that the blade 13 is rotatable about an axis defined by the pivotal connection post 111. The actuating portion 15 has one end pivotally provided on the aforesaid side of the plate 11A at a position adjacent to the opposite end of the plate 11A. Moreover, the top side of the actuating portion 15 is protrudingly provided with a second block 151 at a position adjacent to the aforesaid end of the actuating portion 15. The second block 151 is also rectangular and can rotate along with the actuating portion 15, and the portion between the second block 151 and the actuating portion 15 is also reduced in diameter to form an engaging groove. The plate 11B is formed with a first aperture 112 at a position adjacent to one end of the plate 11B and a second aperture 114 at a position adjacent to the opposite end of the plate 11B. The first aperture 112 and the second aperture 114 are both rectangular. In addition. the first aperture 112 matches the first block 113 in configuration, and the second aperture 114 matches the second block 151 in configuration. The inner wall portion of the plate 11B that corresponds to the bottom of the first aperture 112 is protrudingly provided with an engaging block 1121, and the inner wall portion of the plate 11B that corresponds to the bottom of the second aperture 114 is protrudingly provided with another engaging block.

With continued reference to FIGS. 1A-1D, the folding knife 1 can be put together by its user in the following manner. First, the plate 11B is placed at a specific angle with respect to the plate 11A such that the first aperture 112 corresponds to the first block 113 (see FIG. 1B). Then, the actuating portion 15 is rotated to bring the second block 151 to the orientation shown in FIG. 1B. After that, the first block 113 is inserted through the first aperture 112, and with the engaging block 1121 corresponding to the engaging groove 1111 of the pivotal connection post 111, the plate 11B is rotated so that the second aperture 114 corresponds to the second block 151. The second block 151 is then inserted through the second aperture 114, and with the other engaging block on the plate 11B corresponding to the engaging groove of the actuating portion 15, the actuating portion 15 is rotated again. Consequently, the first block 113 and the second block 151 no longer correspond to the first aperture 112 and the second aperture 114 respectively (see FIG. 1A), and the engaging block 1121 and the other engaging block of the plate 11B are respectively engaged with the blocks 113 and 151. By the same token, the first thing to be done to dismantle the folding knife 1 is to rotate the actuating portion 15 so that the second block 151 corresponds to the second aperture 114. Following that, the plate 11B is rotated until the first aperture 112 corresponds to the first block 113, and only then can the plate 11B and the blade 13 be sequentially detached, allowing individual components to be cleaned or the blade 13 to be replaced.

While the folding knife described above is configured to be disassembled and reassembled by its user, the following problems are expected to arise in practical use:

(1) When disassembling or reassembling the folding knife, the user must adjust the positions of the plates, the blocks, and the actuating portion by turns repeatedly, which complicates the disassembly and reassembly procedures greatly.

(2) With the blocks and the apertures having specific shapes, the user has to adjust the positions of the blocks and the apertures carefully, for each block cannot extend through the corresponding aperture unless the former corresponds to the latter. Positional adjustment of the blocks and the apertures, however, is extremely time-consuming.

(3) The thickness of each engaging block must be equal to or slightly smaller than the height of the corresponding engaging groove in order for each engaging block to engage with the corresponding block after the plate to be operated (i.e., the plate 11B) and the actuating portion are rotated. To this end, it is imperative to control the tolerances of the aforesaid thicknesses and heights within a very small range, or the folding knife will have problem being assembled (meaning the yield of the folding knife will be lowered).

(4) As the blocks are bound to collide respectively with the peripheries of the corresponding apertures when the user disassembles or reassembles the folding knife, the edges of the blocks or of the apertures may be damaged or deformed over time. Should the damage or deformation be severe, engagement between the blocks and their respective apertures will be made impossible, thus hampering normal use of the folding knife.

(5) While each block and the corresponding aperture must be adjusted to corresponding positions in order for the former to pass through the latter, it is difficult to align each block with the corresponding aperture when the folding knife is small, for in that case the blocks and the apertures will also be small. In other words, a reduction in size of the folding knife will add to the difficulty of assembly.

According to the above, the conventional folding knives still leave much to be desired. It is therefore a pressing issue for folding knife designers and manufacturers to develop a novel folding knife whose structural simplicity brings about greater convenience and safety of use.

BRIEF SUMMARY OF THE INVENTION

In view of the fact that the conventional folding knives fail to satisfy every user need, the inventor of the present invention incorporated years of practical experience as well as the spirit of continual improvement into extensive research and repeated trials and finally succeeded in developing a folding knife configured for rapid assembly and disassembly. The invention is intended to provide the general public with a more convenient and safer folding knife than those commercially available.

It is an objective of the present invention to provide a folding knife configured for rapid assembly and disassembly. The folding knife includes a blade and a handle. The handle is assembled from a first handle portion, a second handle portion, an engaging plate, and a switch. The blade is formed with a pivotal connection hole at a position both adjacent to one end of the blade and distant from the tip of the blade. The inner side of the first handle portion is connected to one end of a first engaging post and one end of a second engaging post at positions respectively adjacent to two opposite ends of the first handle portion. The opposite, or second, end of each of the engaging posts is circumferentially provided with an engaging groove. The first engaging post extends through the pivotal connection hole of the blade to pivotally connect the blade to the first handle portion so that the blade can be rotated about an axis defined by the first engaging post. The second handle portion is provided therein with a receiving space. The inner side of the second handle portion is formed with a first engaging hole at a position adjacent to one end of the second handle portion and is formed with a second engaging hole at a position adjacent to the opposite end of the second handle portion. The outer side of the second handle portion is formed with a switch hole. The first engaging hole, the second engaging hole, and the switch hole are in communication with the receiving space. When the second handle portion is assembled to the first handle portion, the second end of the first engaging post extends through the first engaging hole into the receiving space, and the second end of the second engaging post extends through the second engaging hole into the receiving space. The engaging plate is mounted in the receiving space and can be displaced toward either of two opposite ends of the receiving space. The engaging plate is provided with a first engaging portion and a second engaging portion at positions respectively adjacent to two opposite ends of the engaging plate. The first engaging portion matches the first engaging groove in configuration, and the second engaging portion matches the second engaging groove in configuration. The switch extends into and is received in the switch hole and can be displaced toward either of two opposite ends of the switch hole. The inner side of the switch is connected to the engaging plate while the outer side of the switch is exposed through the switch hole. When pushed and thereby displaced toward one of the two opposite ends of the switch hole, the switch displaces the engaging plate toward one of the two opposite ends of the receiving space, thus disengaging the first engaging portion from the first engaging groove and the second engaging portion from the second engaging groove, allowing the first handle portion, the second handle portion, and the blade to be detached from one another. When pushed and thereby displaced to the other of the two opposite ends of the switch hole, the switch displaces the engaging plate toward the other of the two opposite ends of the receiving space, thus bringing the first engaging portion into engagement with the first engaging groove and the second engaging portion into engagement with the second engaging groove. As a result, the first handle portion and the second handle portion are coupled together to form the handle, and the blade can be rotated about the axis defined by the first engaging post in order to store the cutting edge of the blade in the handle or rotate the cutting edge of the blade out of the handle. As a user only has to push the switch in order for the engaging plate to engage with or disengage from the engaging grooves and thereby bring the first handle portion and the second handle portion into a coupled or detachable state, the folding knife can be cleaned with great ease.

BRIEF DESCRIPTION OF THE SEVERAL VIEWS OF THE DRAWINGS

The above and other objectives, as well as the technical features and effects, of the present invention can be better understood by referring to the following detailed description of some illustrative embodiments in conjunction with the accompanying drawings, in which.

DETAILED DESCRIPTION OF THE INVENTION

The present invention provides a folding knife that can be rapidly assembled and disassembled. In one embodiment, referring to FIGS. 2~4, the folding knife is assembled at least from a blade 20A and a handle 20B. The blade 20A is formed with a pivotal connection hole 202 at a position both adjacent to one end of the blade 20A and distant from the tip 201. In addition, the side of the blade 20A that is adjacent to the pivotal connection hole 202 and faces away from the cutting edge 203 is protrudingly provided with a pushing post 204. Once the blade 20A and the handle 20B are put together, the pushing post 204 is exposed from the handle 20B so that one who is holding the folding knife can rotate the blade 20A out of the handle 20B by pushing the pushing post 204 with a finger.

Figure 1A:
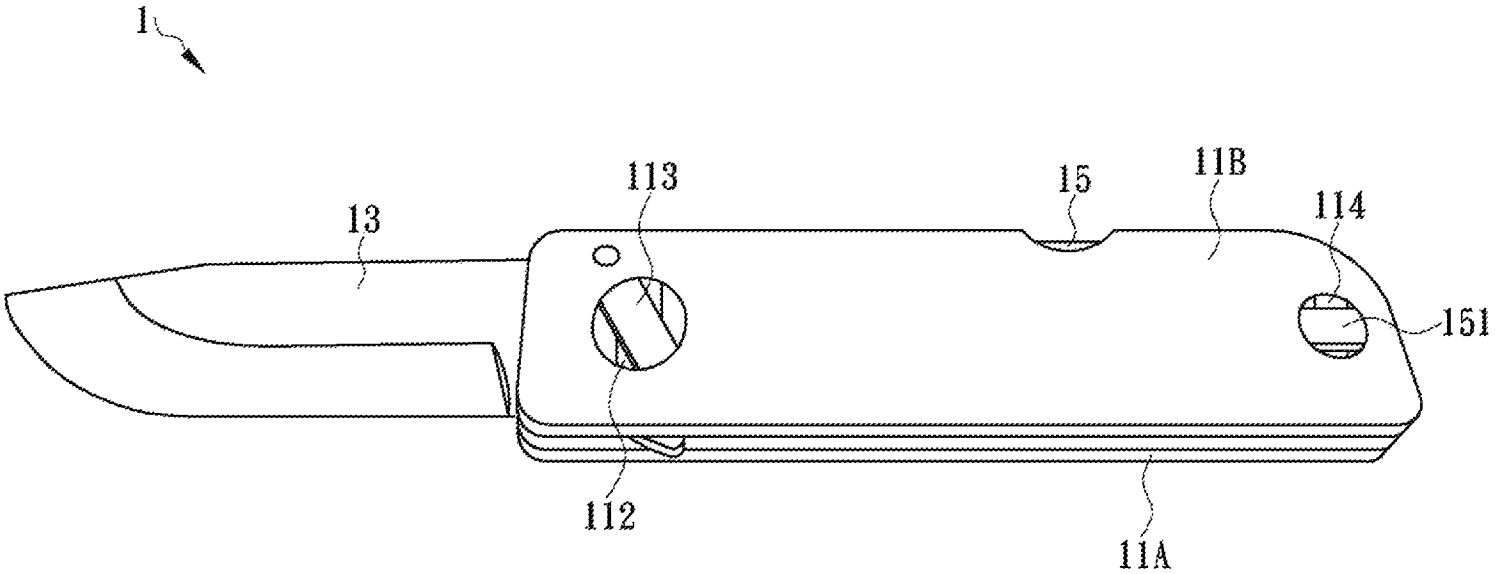
FIG. 1A(Prior Art)
FIG. 1A shows a conventional folding knife in a certain state.
Figure 1B:
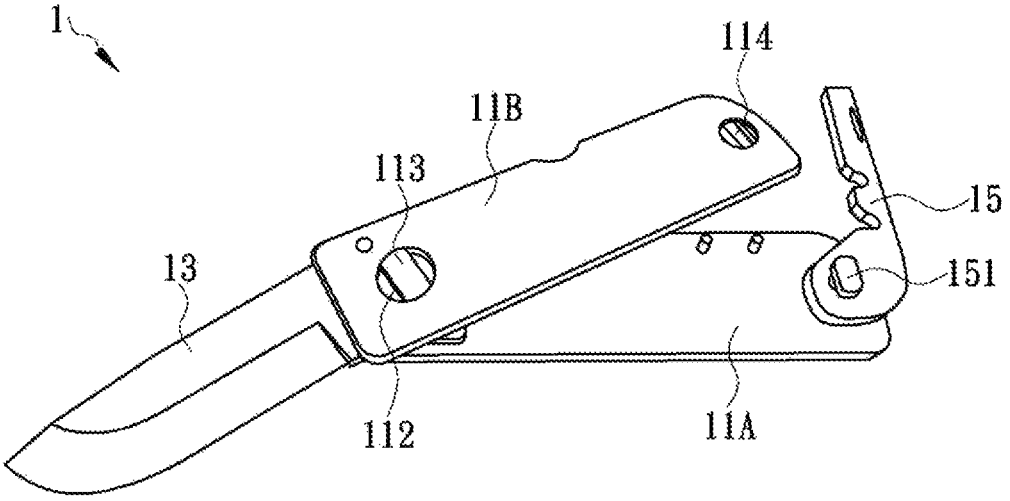
FIG. 1B(Prior Art)
FIG. 1B shows the conventional folding, knife in FIG. 1 in another state.
Figure 1C:
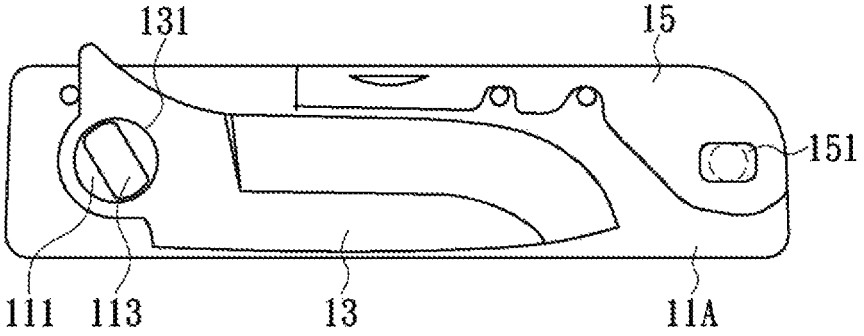
FIG. 1C(Prior Art)
FIG. 1C shows the conventional folding knife in FIG. 1 in still another state.
Figure 1D:
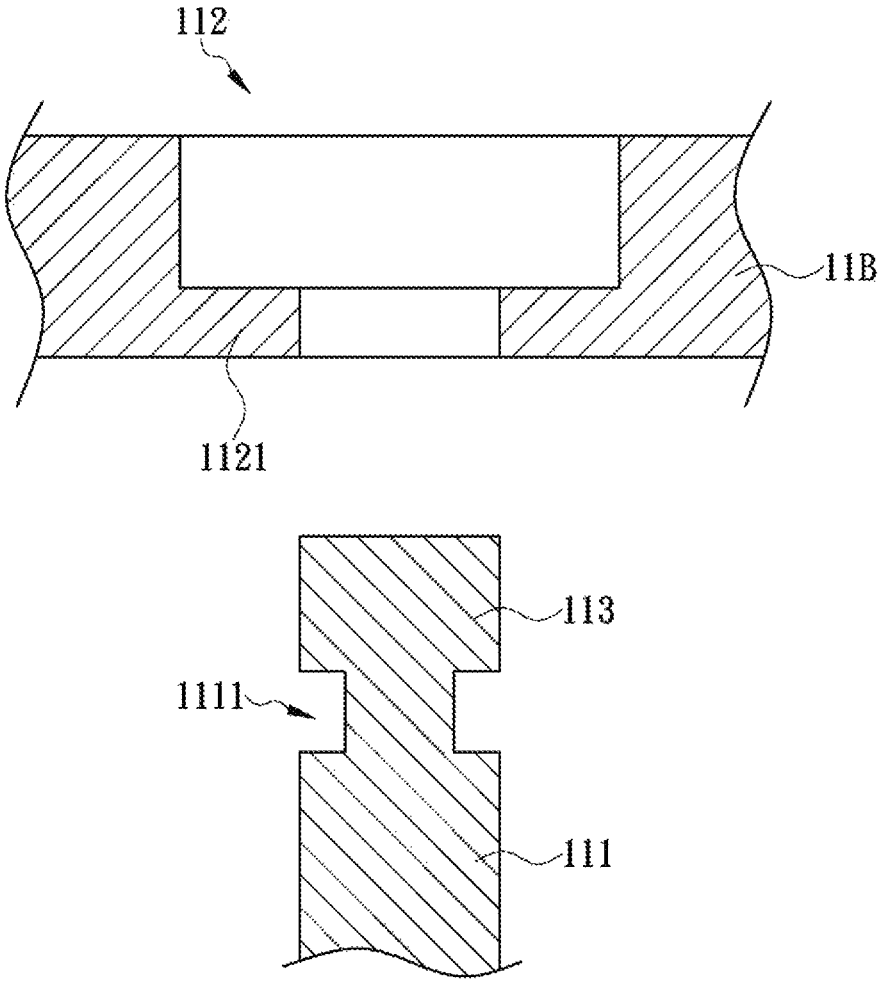
FIG. 1D(Prior Art)
FIG. 1D is a partial sectional view of the two plates of the conventional folding knife in FIG. 1.
Figure 2:
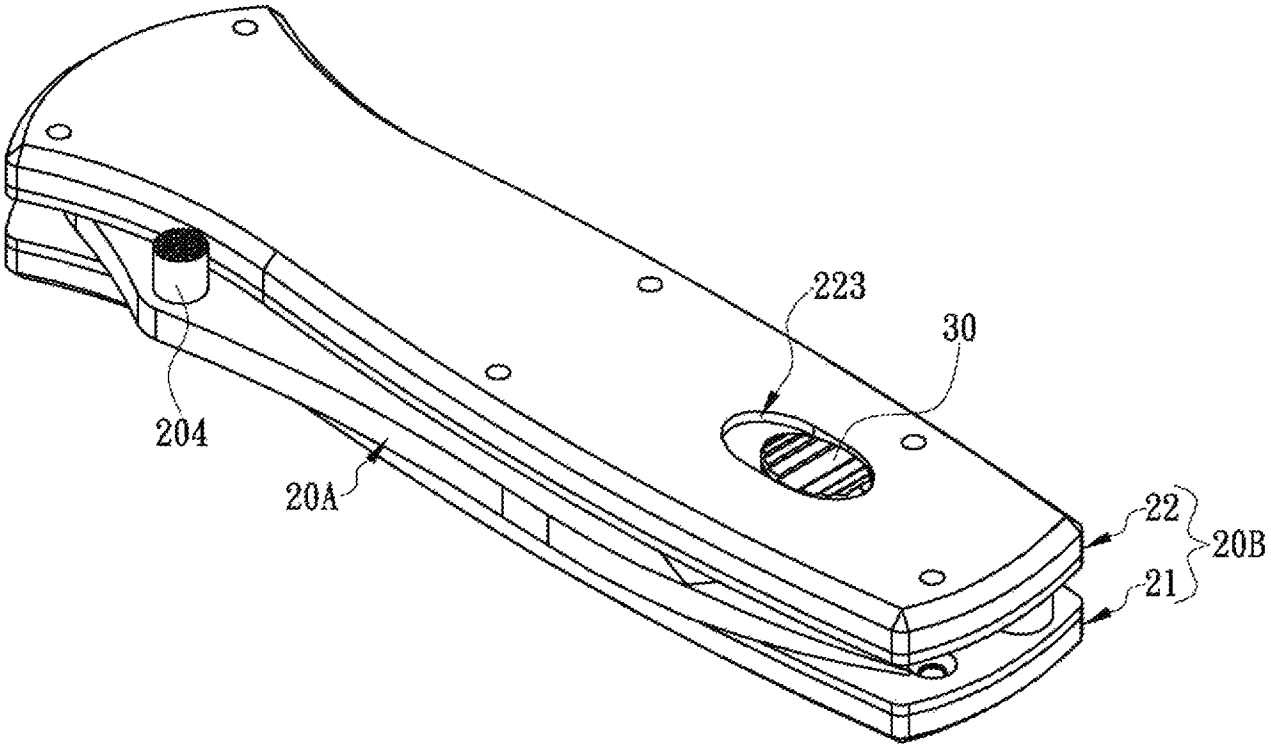
FIG. 2 is an assembled perspective view of a folding knife according to the present invention.
Figure 3:
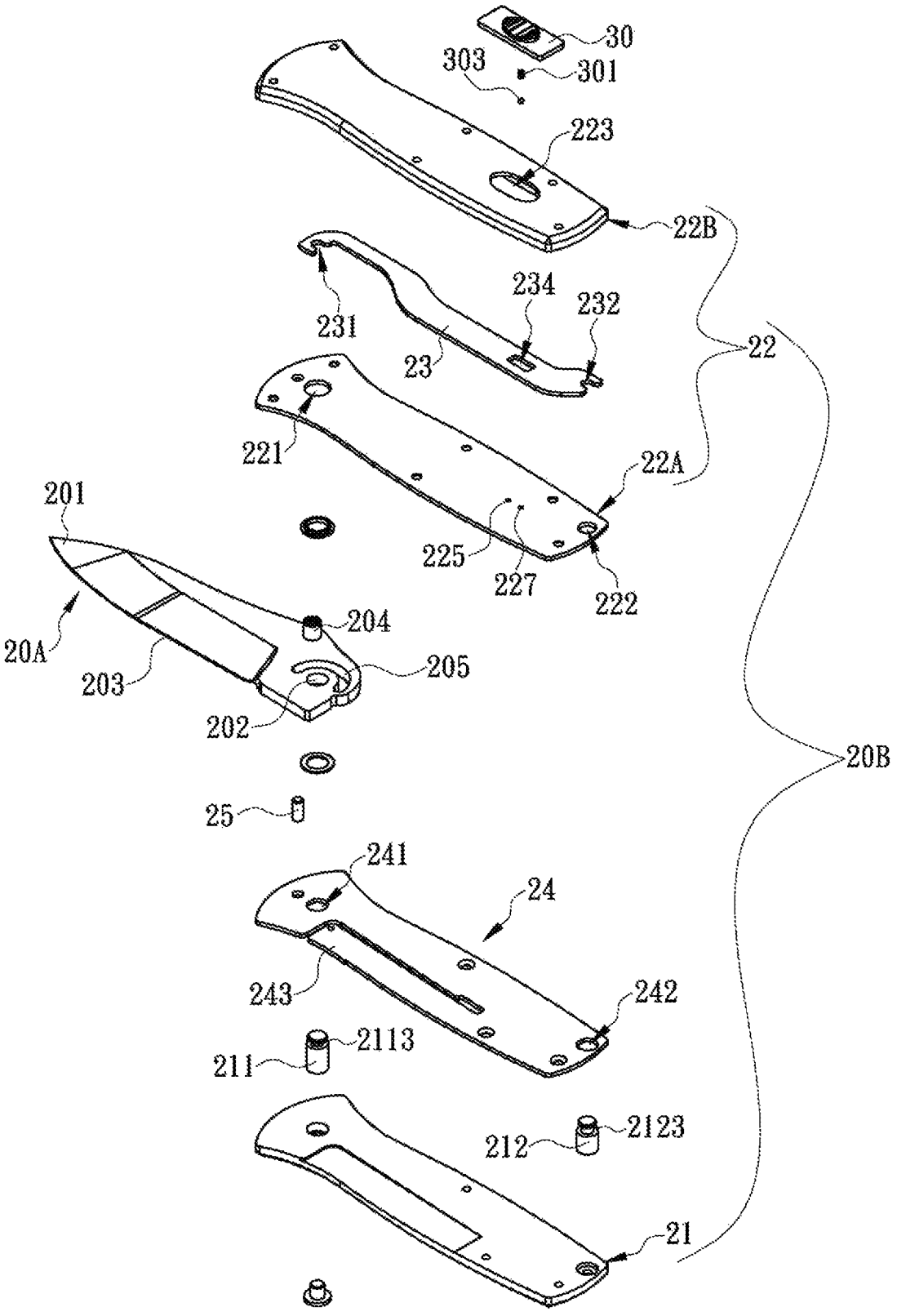
FIG. 3 is an exploded perspective view of the folding knife in FIG. 2.
Figure 4:
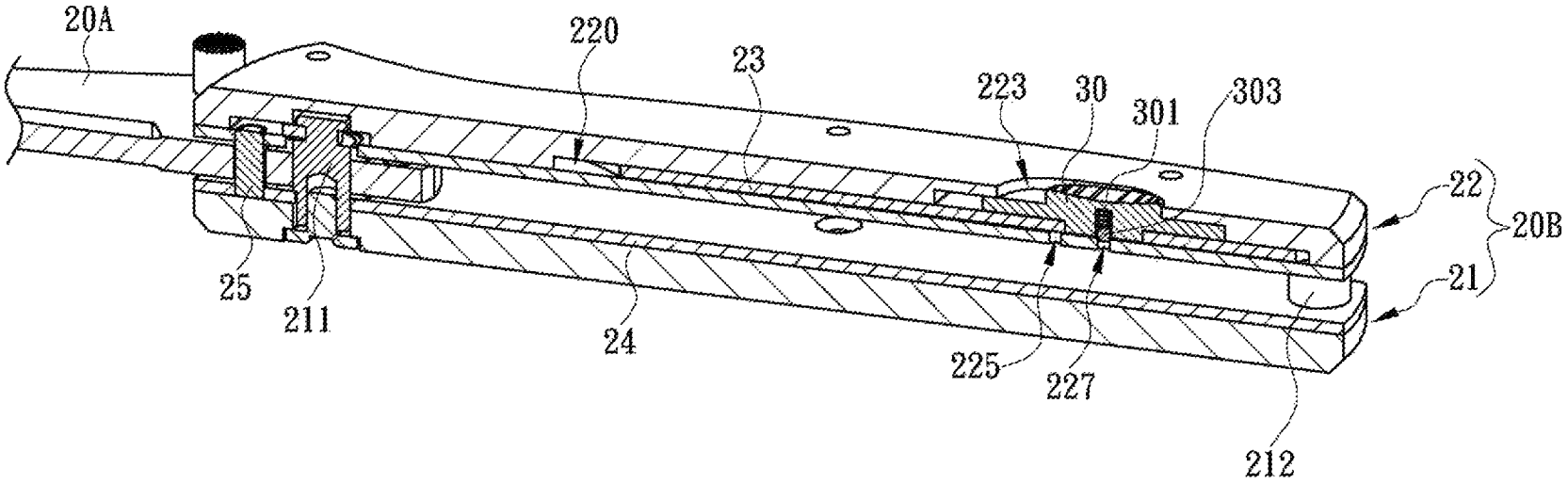
FIG. 4 is a sectional view of the folding knife in FIG. 2.

With continued reference to FIGS. 2~4, the handle 20B includes a first handle portion 21 and a second handle portion 22. The inner side of the first handle portion 21 is protrudingly provided with a first engaging post 211 at a position adjacent to one end of the first handle portion 21 and is protrudingly provided with a second engaging post 212 at a position adjacent to the opposite end of the first handle portion 21. In this embodiment, the first engaging post 211 and the second engaging post 212 are independent components, each configured to be fixed to the inner side of the first handle portion 21 at one end. Moreover, the opposite end (hereinafter referred to as the second end) of the first engaging post 211 is circumferentially provided with a first engaging groove 2113 while the opposite end (hereinafter referred to as the second end) of the second engaging post 212 is circumferentially provided with a second engaging groove 2123. In other embodiments of the present invention, the first engaging post 211 and the second engaging post 212 may be integrally formed with the first handle portion 21 instead to meet production or design requirements, e.g., to reduce the number of components.

Referring again to FIGS. 2~4, the second handle portion 22 is formed therein with a receiving space 220. The inner side of the second handle portion 22 is formed with a first engaging hole 221 at a position adjacent to one end of the second handle portion 22 and is formed with a second engaging hole 222 at a position adjacent to the opposite end (hereinafter referred to as the second end) of the second handle portion 22. In addition, the outer side of the second handle portion 22 is formed with a switch hole 223. The first engaging hole 221, the second engaging hole 222, and the switch hole 223 are in communication with the receiving space 220. In this embodiment, the second handle portion 22 is assembled from an inner part 22A and an outer part 22B, the receiving space 220 is formed between the inner part 22A and the outer part 22B, the first engaging hole 221 and the second engaging hole 222 are provided at two opposite ends of the inner part 22A respectively, and the switch hole 223 is provided in the outer part 22B. In other embodiments of the present invention, the structure of the second handle portion 22 may be adjusted as appropriate to include a single one component or multiple components, provided that the second handle portion 22 has the foregoing structural features. Besides, an engaging plate 23 is mounted in the receiving space 220 of the second handle portion 22. The engaging plate 23 can be displaced toward either of two opposite ends of the receiving space 220 and is formed with a first engaging portion 231 at a position adjacent to one end of the engaging plate 23 and a second engaging portion 232 at a position adjacent to the opposite end of the engaging plate 23. The first engaging portion 231 matches the first engaging groove 2113 in configuration and can be engaged in the first engaging groove 2113. The second engaging portion 232 matches the second engaging groove 2123 in configuration and can be engaged in the second engaging groove 2123.

Figure 5:
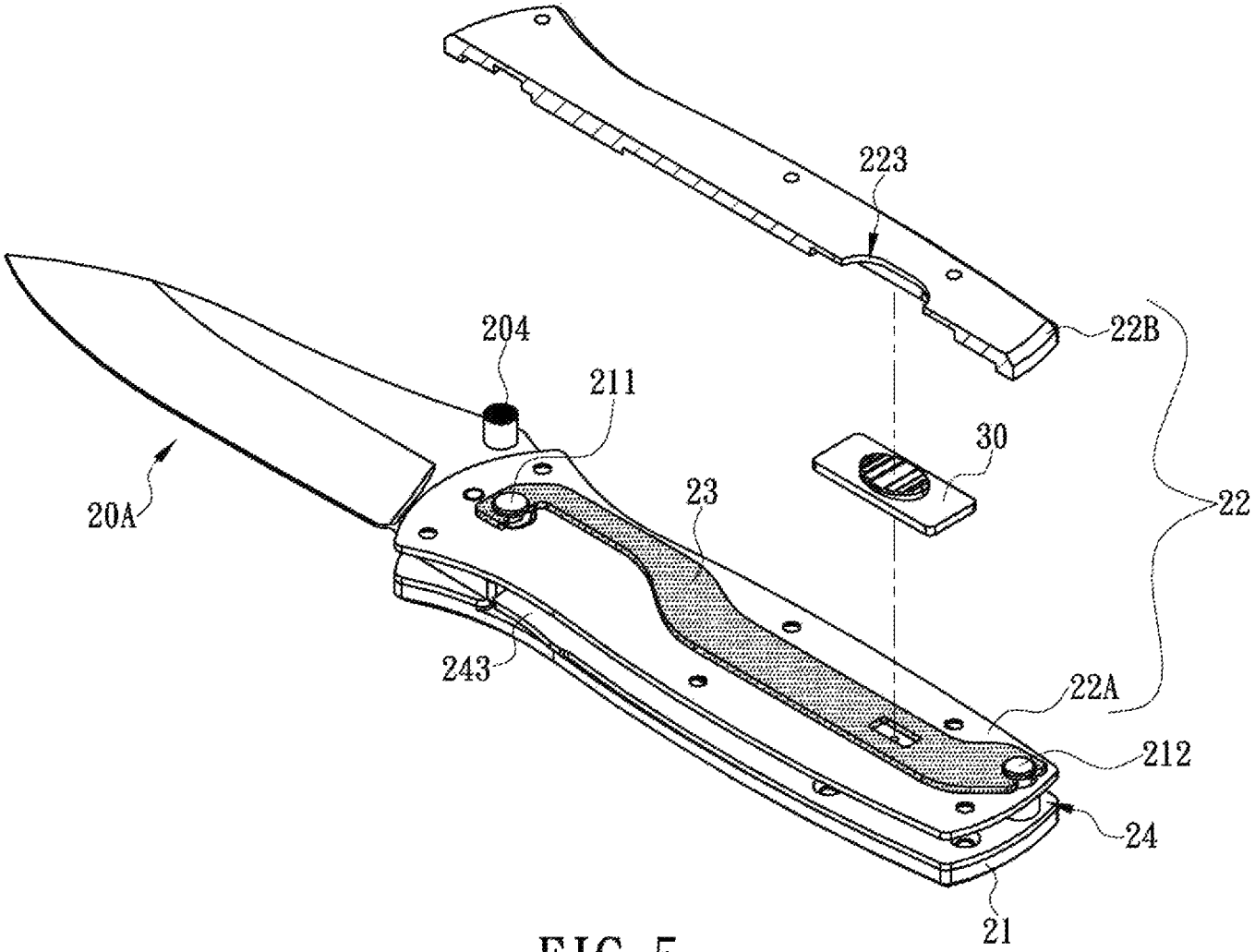
FIG. 5 is a perspective view showing the engaging plate and the engaging posts of the folding knife in FIG. 2 in a certain state.

As shown in FIGS. 2~4, the second handle portion 22 is mounted with a switch 30. The switch 30 extends into and is received in the switch hole 223 and can be displaced toward either of two opposite ends of the switch hole 223. The inner side of the switch 30 is connected to the engaging plate 23 in order for the switch 30 to drive the engaging plate 23 into displacement. The outer side of the switch 30 is exposed through the switch hole 223 so that a user can push the switch 30 with a finger, thereby displacing the engaging plate 23 toward either a first end or an opposite second end of the receiving space 220. Once the blade 20A is pivotally connected to the first handle portion 21 by inserting the first engaging post 211 through the pivotal connection hole 202 of the blade 20A, and the second handle portion 22 is assembled to the first handle portion 21 by inserting the second ends of the first engaging post 211 and of the second engaging post 212 into the first engaging hole 221 and the second engaging hole 222 respectively, the user can bring the first engaging portion 231 and the second engaging portion 232 of the engaging plate 23 respectively into engagement in the first engaging groove 2113 and the second engaging groove 2123 of the engaging plate 23 (see FIG. 5) simply by pushing the switch 30 with a finger and thus displacing the engaging plate 23 toward the second end of the receiving space 220 (e.g., rightward as shown in FIG. 4). Thus, the first handle portion 21 and the second handle portion 22 are rapidly and securely coupled to each other to form the handle 20B, with the engaging portions 231, 232 restricted respectively by the engaging grooves 2113, 2123 to prevent the first handle portion 21 and the second handle portion 22 from separating from each other. The blade 20A can now be rotated about its pivot shaft (i.e. the first engaging post 211) in order to store the cutting edge 203 between the first handle portion 21 and the second handle portion 22, leaving only the pushing post 204 outside the handle 20B (see FIG. 2). In this embodiment, the switch 30 is located on one side of the second handle portion 22 and is adjacent to the second end of the second handle portion 22, the engaging plate 23 is formed with an engaging hole 234, and the switch 30 is assembled to the engaging plate 23 by having the inner side of the switch 30 engaged in the engaging hole 234. In practice, however, the way the switch 30 and the engaging plate 23 are assembled together may be adjusted according to product requirements. The position of the switch hole 223 may also be adjusted so that the switch 30 is located elsewhere on the second handle portion 22, as long as the switch 30 can be used to displace the engaging plate 23.

Figure 6:
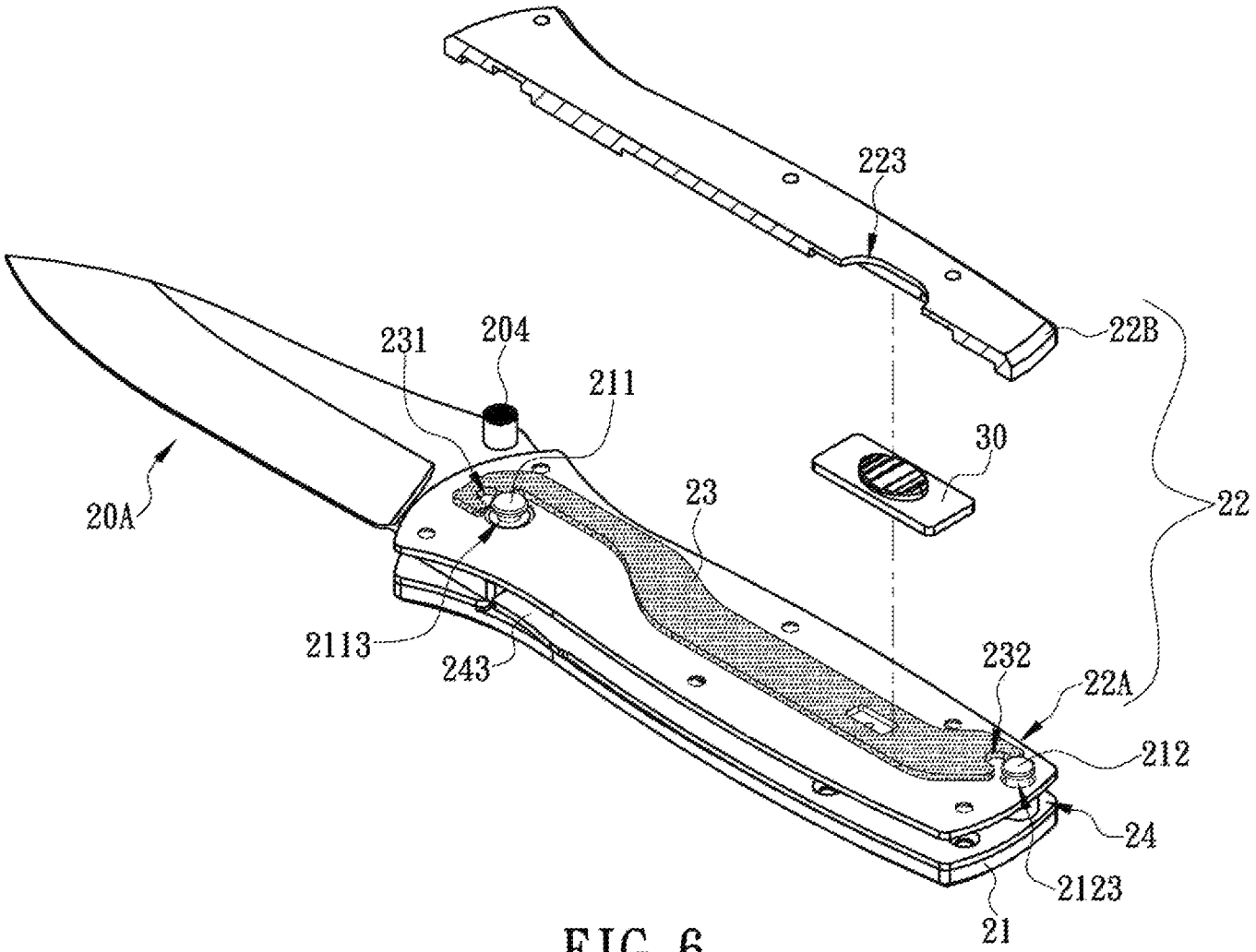
FIG. 6 is a perspective view showing the engaging plate and the engaging posts of the folding knife in FIG. 2 in another state.

Referring again to FIGS. 2~4, when it is desired to disassemble the folding knife in order to get rid of the dirt therein, the user only has to push the switch 30 with a finger and thereby displace the engaging plate 23 toward the first end of the receiving space 220 (e.g., leftward as shown in FIG. 4), and the first engaging portion 231 and the second engaging portion 232 of the engaging plate 23 will be disengaged respectively from the first engaging groove 2113 and the second engaging groove 2123 at the same time (see FIG. 6). Once the engaging portions 231, 232 are no longer engaged in the engaging grooves 2113, 2123 respectively, the user can detach the second handle portion 22 and the blade 20A sequentially from the first handle portion 21 in order to clean the folding, knife or replace the blade 20A with a new one. The structure of the folding knife of the present invention is so designed that, simply by pushing the switch 30, the user can render the folding knife rapidly but surely into a state where disassembly is allowed (see FIG. 6) or a state where disassembly is prevented (see FIG. 5). Now that the complicated steps required to disassemble and reassemble the conventional folding knives are no more necessary, the folding knife of the present invention features greater convenience of use. Furthermore, in contrast to the conventional folding knives (e.g., the folding knife 1 described in Description of Related Art, whose users have to adjust the positions of the blocks and the apertures carefully), the folding knife of the present invention allows the engaging plate 23 to be adjusted in position (to either engage with or disengage from the engaging posts 211. 212) by no more than a push on the switch 30.

In another embodiment of the present invention, referring again to FIGS. 2~4, the folding knife further includes an elastic plate 24 mounted between the first handle portion 21 and the second handle portion 22. The elastic plate 24 is formed with a first through hole 241 at a position adjacent to one end of the elastic plate 24 and is formed with a second through hole 242 at a position adjacent to the opposite end of the elastic plate 24 so that the first engaging post 211 can pass through the first through hole 241 into the first engaging hole 221 while the second engaging post 212 passes through the second through hole 242 into the second engaging hole 222. The elastic plate 24 is further provided with a stopping portion 243. When the blade 20A has been rotated completely out of the handle 20B, the stopping portion 243 is engaged with the aforesaid end of the blade 20A such that the blade 20A cannot be rotated into the handle 20B. Only when the stopping portion 243 is forced out of engagement with the blade 20A can the blade 20A be rotated again and thereby stored in the handle 20B. While the stopping portion 243 is depicted in the drawings as a plate, it is feasible in another embodiment of the present invention to configure the stopping portion 243 otherwise (e.g., as a protuberance), and in that case, the aforesaid end of the blade 20A will be provided with a groove corresponding in position to the protuberance in order to engage with the protuberance.

To prevent excessive rotation of the blade 20A, referring to FIGS. 3 and 4, the blade 20A in still another embodiment of the present invention is formed with a curved position-limiting groove 205 at a position adjacent to the aforesaid end of the blade 20A while the handle 20B is provided therein with a position-limiting post 25. In this embodiment, the position-limiting post 25 extends through the position-limiting groove 205 and has two opposite ends connected respectively to the inner side of the first handle portion 21 and the inner side of the second handle portion 22. The position of the position-limiting post 25 within the position-limiting groove 205 is changed when the blade 20A is rotated. For example, when the blade 20A has been rotated completely out of the handle 20B, the position-limiting post 25 is pressed against the wall of one end of the position-limiting groove 205. When the blade 20A is subsequently rotated to be stored in the handle 20B, the position of the position-limiting post 25 in the position-limiting groove 205 is gradually changed. Once the blade 20A is entirely stored in the handle 20B, the position-limiting post 25 is pressed against the wall of the opposite end of the position-limiting groove 205. Thus, by adjusting the length of the position-limiting groove 205, it can be ensured that the blade 20A will be kept securely at the predetermined terminal positions, without fear that a user may rotate the blade 20A excessively. It should be pointed out that, when the folding knife includes the elastic plate 24, the position-limiting post 25 extends through the elastic plate 24 (see FIG. 4).

Figure 7:
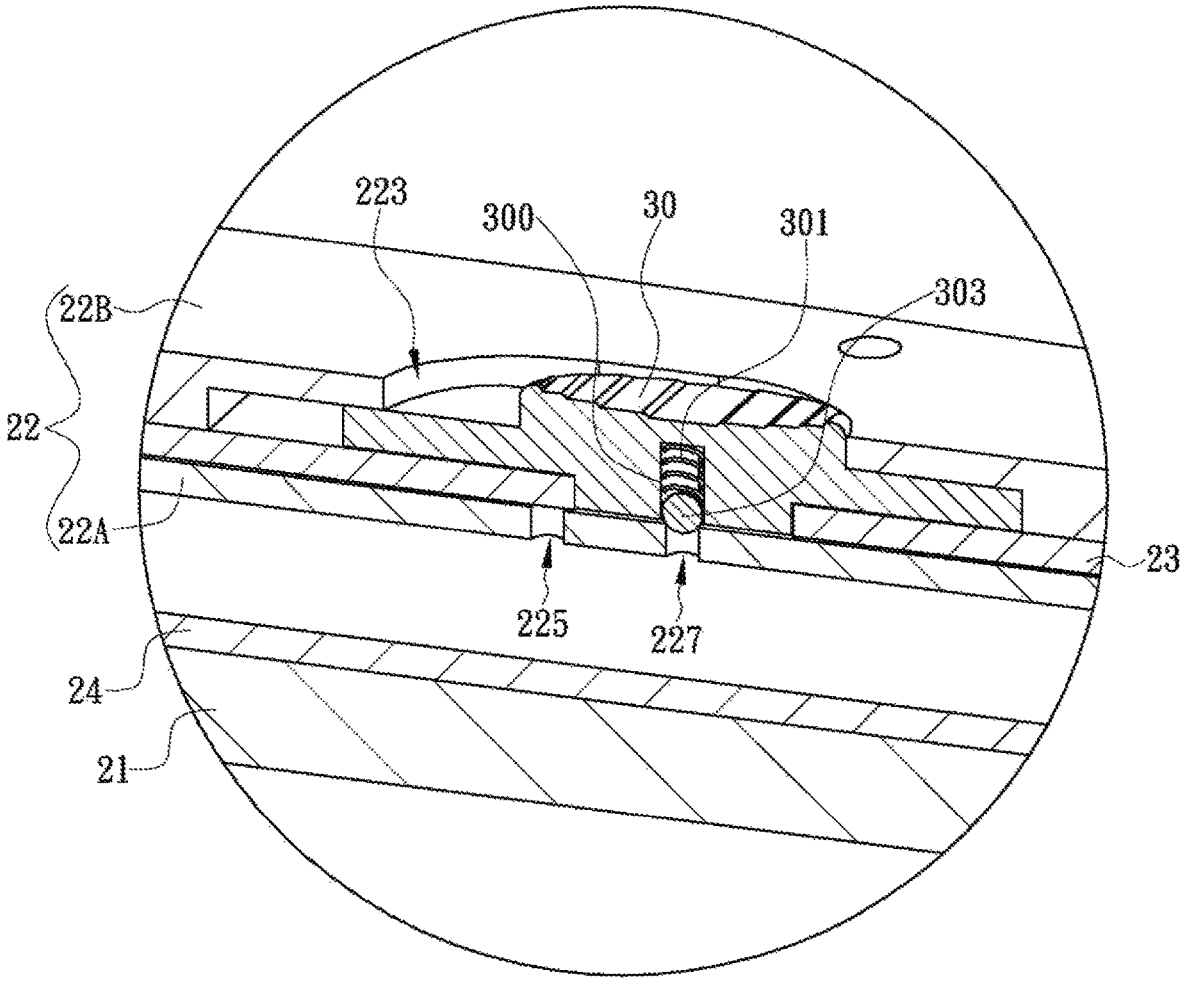
FIG. 7 is a partial sectional view of the switch of the folding knife in FIG. 2.

In yet another embodiment of the present invention, referring, to FIG. 3 and FIG. 7, the bottom side of the switch 30 is formed with a recess 300. The recess 300 is mounted therein, from the inside out, with a spring 301 and a ball 303. In addition, the inner side of the second handle portion 22 is concavely provided with a first positioning hole 225 and a second positioning hole 227, both corresponding in position to the switch hole 223. In this embodiment, the first positioning hole 225 and the second positioning hole 227 are provided in the inner side of the inner part 22A at positions corresponding to the switch hole 223. When the switch 30 has been pushed and thereby displaced to one end of the switch hole 223, the ball 303 corresponds to the first positioning hole 225 and is pushed by the spring 301 into engagement in the first positioning hole 225, thereby securing the switch 30 in place. In the course in which the switch 30 is pushed and thereby displaced in the opposite direction, the ball 303 is forced to push the spring 301 further into the recess 300. Once the switch 30 reaches the opposite end of the switch hole 223, the ball 303 corresponds to the second positioning hole 227 and is pushed by the spring 301 into engagement in the second positioning hole 227, thereby securing the switch 30 where it is. The switch 30, therefore, cannot be displaced without being pushed by a force that can overcome the force applied by the spring 301 to the ball 303. This technical feature allows the folding knife to be placed safely in a bag or pocket because the switch 30 will not be displaced, let alone allow separation of the blade 20A and the handle 20B, even when accidentally pushed by an object in the bag or pocket.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

The invention claimed is:

1. A folding knife comprising:

a blade;

a first handle portion having a front end portion, a back end portion, an inner surface, and an outer surface;

an engaging post extending from the inner surface of the first handle portion;

a second handle portion including a front end portion and a back end portion, wherein the blade is pivotably coupled to the front end portions of the first and second handle portions and can pivot relative to the first and second handle portions about a pivot axis between an open position and a closed position; and an engaging plate movably coupled to the second handle portion and configured for selectively engaging the engaging post, wherein the engaging plate includes a first end and a second end, wherein the first end is directed toward the front end portions of the first and second handle portions, wherein the second end is directed toward the back end portions of the first and second handle portions, and wherein the first end and the second end of the engaging plate are slidable relative to the second handle portion between a first position and a second position, wherein when the folding knife is assembled and the engaging plate is in the first position, the engaging post extends from the first handle portion to the second handle portion and the engaging plate engages the engaging post, thereby restricting relative movement between the first and second handle portions in a direction parallel to the pivot axis and retaining the blade between the first and second handle portions, and wherein when the folding knife is assembled and the engaging plate is moved from the first position to the second position, the engaging plate disengages the engaging post, thereby allowing relative movement between the first and second handle portions in the direction parallel to the pivot axis and allowing the blade to be separated from the first and second handle portions.

2. The folding knife of claim 1, further comprising a switch coupled to the engaging plate, wherein the switch is movable relative to the second handle portion to move the engaging plate between the first and second positions.

3. The folding knife of claim 1, wherein the engaging plate has an engaging portion, wherein when the engaging plate is in the first position, the engaging portion of the engaging plate is configured to engage the engaging post.

4. The folding knife of claim 3, wherein the engaging post has a groove formed therein, and wherein when the engaging plate is in the first position, the engaging portion of the engaging plate extends at least partially into the groove of the engaging post.

5. The folding knife of claim 3, wherein when the engaging plate is in the first position, the engaging portion of the engaging plate does not extend completely around the engaging post.

6. The folding knife of claim 1, wherein the second handle portion comprises an inner part and an outer part, and wherein the engaging plate is disposed in a receiving space between the inner part and the outer part of the second handle portion.

7. The folding knife of claim 6, wherein the inner part of the second handle portion includes an opening configured such that the engaging post can extend therethrough, wherein the outer part of the second handle portion comprises a hole configured for receiving the engaging post.

8. The folding knife of claim 7, wherein the opening extends completely through the inner part of the second handle portion, and wherein the hole extends only partially through the outer part of the second handle portion.

9. The folding knife of claim 1, wherein the engaging post is a first engaging post, and the folding knife further comprises a second engaging post extending from the inner surface of the first handle portion, wherein the first and second engaging posts are spaced apart from each other, wherein the engaging plate is configured for selectively engaging the first and second engaging posts.

10. A folding knife comprising:

a blade;

a first handle portion;

a second handle portion having a first end, a second end, and a longitudinal axis extending from the first end to the second end, wherein the blade is pivotably coupled to the first and second handle portions and is pivotable relative to the first and second handle portions about a pivot axis between an open position and a closed position, wherein the pivot axis is perpendicular to the longitudinal axis;

a post extending from the first handle portion; and an engaging plate coupled to the second handle portion, wherein the engaging plate is movable relative to the second handle portion in a direction parallel to the longitudinal axis of the second handle portion between a first position and a second position, wherein in the first position, the engaging plate engages the post, thereby restricting relative movement between the first and second handle portions in a direction parallel to the pivot axis and retaining the blade between the first and second handle portions, and wherein in the second position, the engaging plate disengages the post, thereby allowing relative movement between the first and second handle portions in the direction parallel to the pivot axis and allowing the blade to be separated from the first and second handle portions.

11. The folding knife of claim 10, wherein the post has an annular groove formed therein, and wherein when the engaging plate is in the first position, the engaging plate extends at least partially into the annular groove of the post.

12. The folding knife of claim 11, wherein the engaging plate has a U-shaped portion configured to extend into the annular groove of the post.

13. The folding knife of claim 10, further comprising a switch coupled to the engaging plate, wherein the switch is movable relative to the second handle portion to move the engaging plate between the first and second positions.

14. The folding knife of claim 13, further comprising a retention mechanism configured to prevent the switch from being accidentally moved relative to the second handle portion.

15. The folding knife of claim 14, wherein the retention mechanism comprises a spring and a ball, wherein the spring and the ball are at least partially disposed in a recess of the switch, wherein the ball is movable relative to the second handle portion between a first opening and a second opening of the second handle portion, wherein the first opening of the second handle portion corresponds to the first position of the engaging plate, and wherein the second opening of the second handle portion corresponds to the second position of the engaging plate.

16. The folding knife of claim 10, wherein the second handle portion comprises an inner part and an outer part, and wherein the engaging plate is disposed between the inner part and the outer part of the second handle portion.

17. The folding knife of claim 16, wherein the outer part of the second handle portion comprises a recessed portion configured for receiving the engaging plate.

18. A folding knife comprising:

a first handle portion;

a second handle portion spaced apart from the first handle portion, a blade disposed between the first and second handle portions, wherein the blade is pivotable relative to the first and second handle portions about a pivot axis between an open position and a closed position;

a first engaging post extending from the first handle portion at a first location on the first handle portion;

an engaging plate coupled to the second handle portion, the engaging plate having a first end portion, wherein the first end portion of the engaging plate is configured for selectively engaging the first engaging post, and wherein the engaging plate is slidable relative to the second handle portion between a locked position engaging the first engaging post and an unlocked position spaced from the first engaging post; and a switch coupled to the engaging plate and movable relative to the second handle portion, wherein the switch is configured for moving the engaging plate between the locked position and the unlocked position, and wherein the switch is restricted from moving relative to the second handle portion in a direction parallel to the pivot axis, wherein when the folding knife is in an assembled configuration and the switch is positioned relative to the second handle portion such that the engaging plate is in the locked position, the first engaging post extends from the first handle portion and into the second handle portion, and the engaging plate engages the first engaging post, thereby restricting relative movement between the first and second handle portions in the direction parallel to the pivot axis and retaining the blade between the first and second handle portions, and wherein when the folding knife is in the assembled configuration and the switch is positioned relative to the second handle portion such that the engaging plate is in the unlocked position, the engaging plate is disengaged from the first engaging post, thereby allowing relative movement between the first and second handle portions in the direction parallel to the pivot axis and allowing the blade to be separated from the first and second handle portions.

19. The folding knife of claim 18, further comprising a second engaging post extending from the first handle portion at a second location on the first handle portion that is spaced apart from the first location, wherein the engaging plate has a second end portion configured for selectively engaging the second engaging post, wherein in the locked position, the engaging plate engages the first and second engaging posts, and wherein in the unlocked position, the engaging plate is spaced from the first and second engaging posts.

20. The folding knife of claim 19, wherein the second handle portion includes a first opening and a second opening, and wherein in the assembled configuration, the first engaging post extends at least partially into the first opening of the second handle portion and the second engaging post extends at least partially into the second opening of the second handle portion.

* * * * *